US012129141B2

(12) United States Patent
Takato

(10) Patent No.: US 12,129,141 B2
(45) Date of Patent: Oct. 29, 2024

(54) MEDIUM EJECTION APPARATUS TO CHANGE ANGLE OF EXTENSION TRAY

(71) Applicant: PFU LIMITED, Kahoku (JP)

(72) Inventor: Yuki Takato, Kahoku (JP)

(73) Assignee: PFU LIMITED, Kahoku (JP)

( * ) Notice: Subject to any disclaimer, the term of this patent is extended or adjusted under 35 U.S.C. 154(b) by 129 days.

(21) Appl. No.: 18/153,860

(22) Filed: Jan. 12, 2023

(65) Prior Publication Data

US 2023/0257225 A1 Aug. 17, 2023

(30) Foreign Application Priority Data

Feb. 16, 2022 (JP) ..... 2022-022168

(51) Int. Cl.

| | |
|---|---|
| ***B65H 31/20*** | (2006.01) |
| ***B65H 29/12*** | (2006.01) |
| ***B65H 29/14*** | (2006.01) |
| ***B65H 31/02*** | (2006.01) |

(52) U.S. Cl.

CPC ..... *B65H 31/20* (2013.01); *B65H 29/125* (2013.01); *B65H 29/14* (2013.01); *B65H 31/02* (2013.01); *B65H 2301/4212* (2013.01); *B65H 2402/46* (2013.01); *B65H 2405/1111* (2013.01); *B65H 2405/11151* (2013.01); *B65H 2405/111646* (2013.01); *B65H 2405/1124* (2013.01); *B65H 2405/3322* (2013.01); *B65H 2511/11* (2013.01); *B65H 2511/214* (2013.01); *B65H 2801/09* (2013.01); *B65H 2801/39* (2013.01)

(58) Field of Classification Search

CPC ..... B65H 31/20; B65H 2404/7414; B65H 2404/1111; B65H 2405/11151; B65H 2405/1116; B65H 2405/11162; B65H 2405/111646; B65H 2405/1117; B65H 2405/1124; B65H 2405/1134; B65H 2405/354; B65H 2511/214; B65H 31/02

See application file for complete search history.

(56) References Cited

U.S. PATENT DOCUMENTS

| | | | | |
|---|---|---|---|---|
| 10,737,898 | B2 * | 8/2020 | Obara | B65H 31/20 |
| 2020/0371465 | A1 | 11/2020 | Nakamura et al. | |

FOREIGN PATENT DOCUMENTS

| | | | |
|---|---|---|---|
| JP | 2006-168897 | A | 6/2006 |
| JP | 2021-119099 | A | 8/2021 |

* cited by examiner

*Primary Examiner* — Jeremy R Severson
(74) *Attorney, Agent, or Firm* — LEWIS ROCA ROTHGERBER CHRISTIE LLP

(57) ABSTRACT

A medium ejection apparatus includes an ejection tray having a first stacking surface, and an extension tray rotatably attached to an end part of the ejection tray at a downstream side in a medium ejection direction, and having a second stacking surface. An end part of the ejection tray at the downstream side is provided with a first abutting part and a second abutting part. An end part of the extension tray at the ejection tray side is provided with a first abutted part and a second abutted part. The second stacking surface is located forming a first angle with respect to the first stacking surface by the first abutted part abutting against the first abutting part. The second stacking surface is located forming a second angle, different from the first angle, with respect to the first stacking surface by the second abutted part abutting against the first abutting part.

5 Claims, 15 Drawing Sheets

MEDIUM EJECTION APPARATUS TO CHANGE ANGLE OF EXTENSION TRAY

CROSS-REFERENCE TO RELATED APPLICATIONS

This application is based upon and claims the benefit of priority of prior Japanese Patent Application No. 2022-022168, filed on Feb. 16, 2022, the entire contents of which are incorporated herein by reference.

TECHNICAL FIELD

Embodiments described in the present specification relate to a medium ejection apparatus having a tray for stacking an ejected medium.

BACKGROUND

A scanner or other medium ejection apparatus conveys a medium while capturing an image and then ejects it. Such a medium ejection apparatus is used in various environments. The optimal arrangement position of a tray for stacking an ejected medium differs depending on the environment in which the medium ejection apparatus is used.

A paper ejection tray which pivots with respect to a recording device body has been disclosed (see Japanese Unexamined Patent Publication No. 2006-168897). A slide type auxiliary tray inserted into this paper ejection tray body is exposed from a top surface of the paper ejection tray body and is made to abut against a projecting shape provided at the recording device body. In the state where the auxiliary tray is pulled out, a rib shape provided inside the paper ejection tray body abuts against the projecting shape. Due to this, the angle of the paper ejection tray changes along with the insertion or pullout of the auxiliary tray.

A sheet stacking device having a sheet stacking member with a part at an upstream side of the sheet conveyance direction able to move in an up-down direction and a biasing means for biasing the sheet stacking member upward is previously disclosed (see Japanese Unexamined Patent Publication No. 2021-119099). This sheet stacking device sets the angle of the sheet stacking device with respect to a sheet insertion part in the sheet conveyance direction to a first angle and a second angle.

SUMMARY

According to some embodiments, a medium ejection apparatus includes an ejection roller to eject a medium, an ejection tray having a first stacking surface, to stack a medium ejected by the ejection roller, and an extension tray rotatably attached to an end part of the ejection tray at a downstream side in a medium ejection direction, and having a second stacking surface, to stack a medium ejected by the ejection roller. An end part of the ejection tray at the downstream side is provided with a first abutting part and a second abutting part. An end part of the extension tray at the ejection tray side is provided with a first abutted part and a second abutted part. The second stacking surface is located forming a first angle with respect to the first stacking surface by the first abutted part abutting against the first abutting part. The second stacking surface is located forming a second angle, different from the first angle, with respect to the first stacking surface by the second abutted part abutting against the first abutting part.

DESCRIPTION OF EMBODIMENTS

It is to be understood that both the foregoing general description and the following detailed description are exemplary and explanatory, and are not restrictive of the invention, as claimed.

Hereinafter, a medium ejection apparatus according to some embodiments will be described with reference to the drawings. However, it should be noted that the technical scope of the invention is not limited to these embodiments, and extends to the inventions described in the claims and their equivalents.

Figure 1:
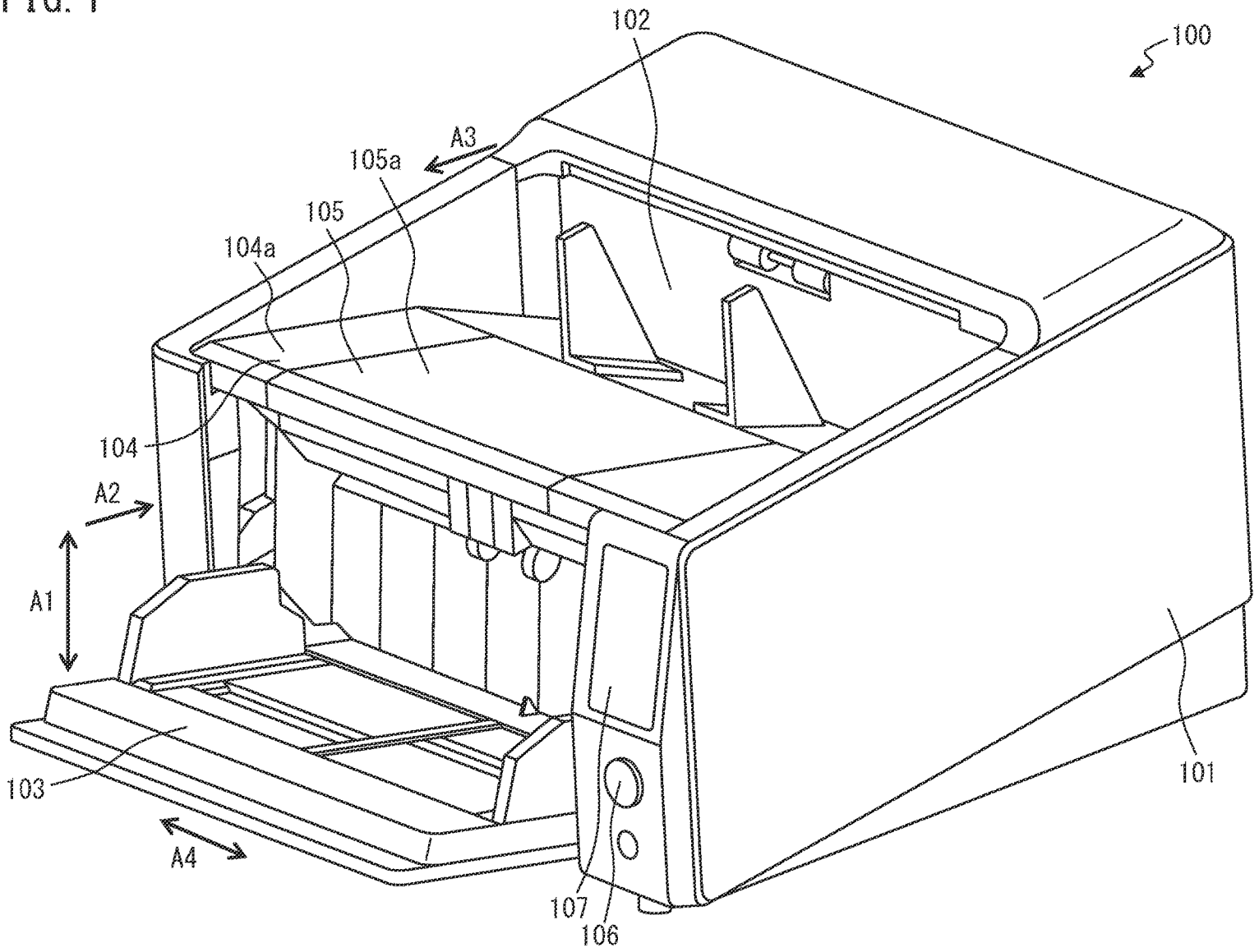
FIG. 1 is a perspective view showing a medium ejection apparatus 100.

FIG. 1 is a perspective view showing a medium ejection apparatus 100 configured as an image scanner. The medium ejection apparatus 100 conveys and captures an image of a medium configured as a document. The medium is printing paper, thick paper, cards, etc. The medium ejection apparatus 100 may be a facsimile, a copier, a multifunction peripheral (MFP), etc. Note that the medium which is conveyed may not be a document, but may be some other object to be printed and the medium ejection apparatus 100 may be a printer, etc.

In FIG. 1, an arrow A1 shows an approximately vertical direction (height direction), an arrow A2 shows a medium conveyance direction, an arrow A3 shows a medium ejection direction, and an arrow A4 shows a width direction perpendicular to the medium conveyance direction A2 or a medium ejection direction A3. Below, "upstream" means upstream in the medium conveyance direction A2 or the medium ejection direction A3, while "downstream" means downstream in the medium conveyance direction A2 or the medium ejection direction A3.

In FIG. 1, an arrow A1 shows an approximately vertical direction (height direction), an arrow A2 shows a medium conveyance direction, an arrow A3 shows a medium ejection direction, and an arrow A4 shows a width direction perpendicular to the medium conveyance direction A2 or a medium ejection direction A3. Below, "upstream" means upstream in the medium conveyance direction A2 or the medium ejection direction A3, while "downstream" means downstream in the medium conveyance direction A2 or the medium ejection direction A3.

The medium ejection apparatus 100 is provided with a first housing 101, a second housing 102, stacking tray 103, ejection tray 104, extension tray 105, operating device 106, display device 107, etc.

The second housing 102 is located at the inside of the first housing 101 and pivotably engages with the first housing 101 by a hinge so as to be able to be opened and closed at the time of medium clogging, the time of cleaning the inside of the medium ejection apparatus 100, etc.

The stacking tray 103 engages with the first housing 101 to enable stacking of the medium to be conveyed. The stacking tray 103 is provided at the side surface of the first housing 101 at the medium feed side to be able to move in the height direction A1. When the medium is not being conveyed, the stacking tray 103 is located at the position of the bottom end so that the medium is easily stacked and when the medium is being conveyed, the medium stacked at the topmost side rises up to a position contacting a later explained pick roller.

The ejection tray 104 is formed on the second housing 102. The ejection tray 104 has a first stacking surface 104*a* for stacking the medium and stacks the medium ejected from the ejection opening of the first housing 101 and second housing 102.

The extension tray 105 is located on the first stacking surface 104*a* of the ejection tray 104. The extension tray 105 has a first surface 105*a* for stacking the medium and stacks the medium ejected from the ejection opening of the first housing 101 and second housing 102.

The operating device 106 has buttons or other input devices and an interface circuit for acquiring signals from the input devices, receives input operations of a user, and outputs operating signals corresponding to the input operations of a user. The display device 107 has a display including liquid crystals, organic EL's (Electro-Luminescence), etc., and an interface circuit for outputting image data to the display, to output the image data to the display. Note that the display device 107 may also be a liquid crystal display with a touch panel function. In this case, the operating device 106 has an interface circuit for acquiring input signals from the touch panel.

Figure 2:
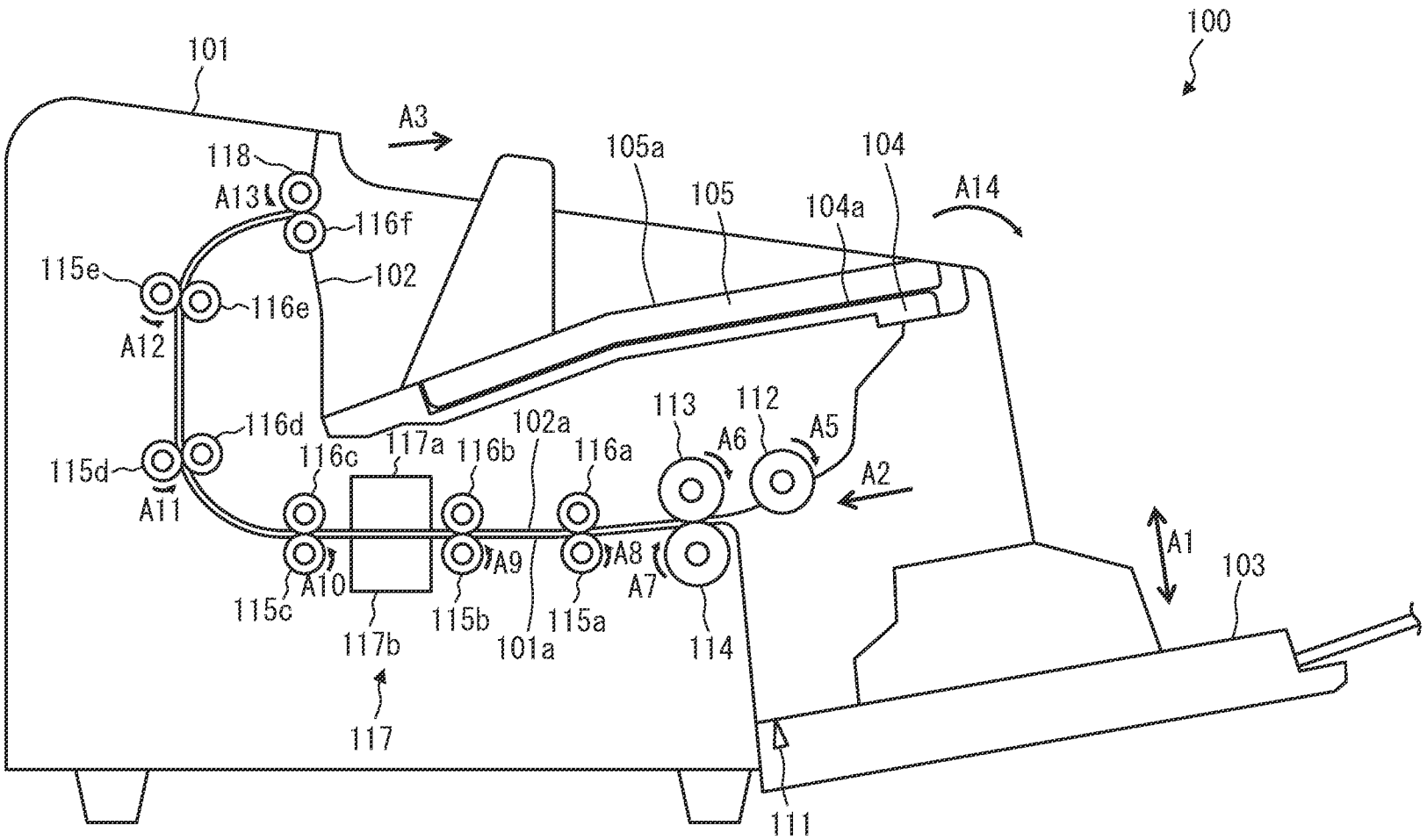
FIG. 2 is a view for explaining a conveyance route of an inside of a medium ejection apparatus 100.

FIG. 2 is a view for explaining a conveyance route at the inside of the medium ejection apparatus 100.

The conveyance route at the inside of the medium ejection apparatus 100 includes a medium sensor 111, pick roller 112, feed roller 113, separation roller 114, first to fifth conveyance rollers 115*a* to 115*e*, first to sixth driven rollers 116*a* to 116*f*, imaging device 117, ejection roller 118, etc.

Note that the pick roller 112, feed roller 113, separation roller 114, first to fifth conveyance rollers 115*a* to 115*e*, first to sixth driven rollers 116*a* to 116*f*, and/or ejection roller 118 are not limited in number to one each. Multiple ones may also be provided. In this case, the multiple feed rollers 113, separation rollers 114, first to fifth conveyance rollers 115*a* to 115*e*, first to sixth driven rollers 116*a* to 116*f*, and/or ejection rollers 118 are respectively located spaced apart in the width direction A4.

The surface of the first housing 101 facing the second housing 102 forms a first guide 101*a* of the medium conveyance path, while the surface of the second housing 102 facing the first housing 101 forms a second guide 102*a* of the medium conveyance path.

The medium sensor 111 is located at the stacking tray 103, i.e., at the upstream side of the feed roller 113 and separation roller 114, and detects the stacked state of the medium at the stacking tray 103. The medium sensor 111 determines whether the stacking tray 103 has the medium stacked on it by a contact detection sensor through which a predetermined current flows when the medium is in contact with it or the medium is not in contact with it. The medium sensor 111 generates and outputs a medium signal changing in signal value between a state where the stacking tray 103 has the medium stacked on it and a state where it does not have the medium stacked on it. Note that the medium sensor 111 is not limited to a contact detection sensor. As the medium sensor 111, a light detection sensor or any other sensor able to detect the presence of a medium may be used.

The pick roller 112 is provided at the second housing 102 and contacts the medium stacked on the stacking tray 103 risen to a height substantially equal to the medium conveyance path then feeds the medium toward the downstream side.

The feed roller 113 is provided inside the second housing 102 at the downstream side of the pick roller 112 and feeds the medium stacked on the stacking tray 103 and fed by the pick roller 112 toward the further downstream side. The separation roller 114 is provided inside the first housing 101 facing the feed roller 113. The separation roller 114 is a so-called "brake roller" and or "retard roller" and is provided rotatably in the opposite direction of the medium feed direction or stoppably. The feed roller 113 and separation roller 114 perform a separation operation of the medium and separates and feeds the medium one by one. The feed roller 113 is located at an upper side with respect to the separation roller 114. The medium ejection apparatus 100 feeds the medium by the so-called top feed system. Note that the feed roller 113 may be located at a lower side with respect to the separation roller 114, and the medium ejection apparatus 100 may feed the medium by the so-called bottom feed system as well.

The first to fifth conveyance rollers 115*a* to 115*e* and first to fifth driven rollers 116*a* to 116*e* are provided facing each other at the downstream side of the feed roller 113 and the separation roller 114 and convey the medium fed by the feed roller 113 and separation roller 114 toward the downstream side.

The imaging device 117 is located at the downstream side of the first to second conveyance rollers 115*a* to 115*b* in the medium conveyance direction A2 and captures an image of the medium conveyed by the first to second conveyance rollers 115*a* to 115*b* and the first to second driven rollers 116*a* to 116*b*. The imaging device 117 includes a first imaging device 117*a* and a second imaging device 117*b* located facing each other across the medium conveyance path.

The first imaging device 117*a* has a contact optical system type CIS (contact image sensor) line sensor having imaging elements comprised of CMOS's (complementary metal oxide semiconductors) located in a line in the main scan direction. Further, the first imaging device 117*a* has a lens for forming an image on the imaging elements and an A/D converter for amplifying the electrical signal output from the imaging elements and converting it from an analog to digital (A/D) format. The first imaging device 117*a* captures an image of the front surface of the conveyed medium to generate and output an input image.

Similarly, the second imaging device 117*b* has a contact optical system type CIS line sensor having imaging elements comprised of CMOS's located in a line in the main scan direction. Further, the second imaging device 117*b* has a lens for forming an image on the imaging elements and an A/D converter for amplifying the electrical signal output from the imaging elements and converting it from an analog to digital (A/D) format. The second imaging device 117*b* captures an image of the back surface of the conveyed medium to generate and output an input image.

Note that the medium ejection apparatus 100 may have only one of the first imaging device 117*a* and the second imaging device 117*b* and may read only one surface of the medium. Further, instead of the contact optical system type CIS line sensor provided with imaging elements comprised of CMOS's, a contact optical system type CIS line sensor provided with imaging elements comprised of CCD's (charge coupled devices) may also be utilized. Further, a reduction optical system type line sensor provided with imaging elements comprised of CMOS's or CCD's may also be used.

The ejection roller 118 and the sixth driven roller 116*f* are provided facing each other at the downstream side of the first to fifth conveyance rollers 115*a* to 115*e*. The ejection roller 118 and the sixth driven roller 116*f* eject the medium conveyed by the first to fifth conveyance rollers 115*a* to 115*e* and the first to fifth driven rollers 116*a* to 116*e* to the ejection tray 104 and the extension tray 105.

The medium stacked on the stacking tray 103 is conveyed between the first guide 101*a* and the second guide 102*a* toward the medium conveyance direction A2 by the pick roller 112 and the feed roller 113 respectively rotating in the medium feed directions A5, A6. The medium ejection apparatus 100 has, as feed modes, a separation mode for feeding the medium while separating it and a nonseparation mode for feeding the medium without separating it. The feed mode is set by a user using the operating device 106 or an information processing apparatus communicating and connected with medium ejection apparatus 100. If the feed mode is set to the separation mode, the separation roller 114 rotates in the direction of the arrow A7, i.e., the direction opposite to the medium feed direction, or stops. Due to this, feed of the medium other than the separated medium is limited (prevention of multi-feed). On the other hand, if the feed mode is set to the nonseparation mode, the separation roller 114 rotates in the opposite direction of the arrow A7, i.e., the medium feed direction.

The medium is guided by the first guide 101*a* and the second guide 102*a* while the first to the second conveyance rollers 115*a* to 115*b* rotate in the direction of the arrows A8 to A9 whereby it is fed to the imaging position of the imaging device 117 and is captured by the imaging device 117. Further, the medium is ejected on the ejection tray 104 and extension tray 105 by the third to the fifth conveyance rollers 115*c* to 115*e* and ejection roller 118 respectively rotating in the directions of the arrows A10 to A13. The ejection tray 104 and the extension tray 105 stack the medium ejected by the ejection roller 118.

Figure 3:
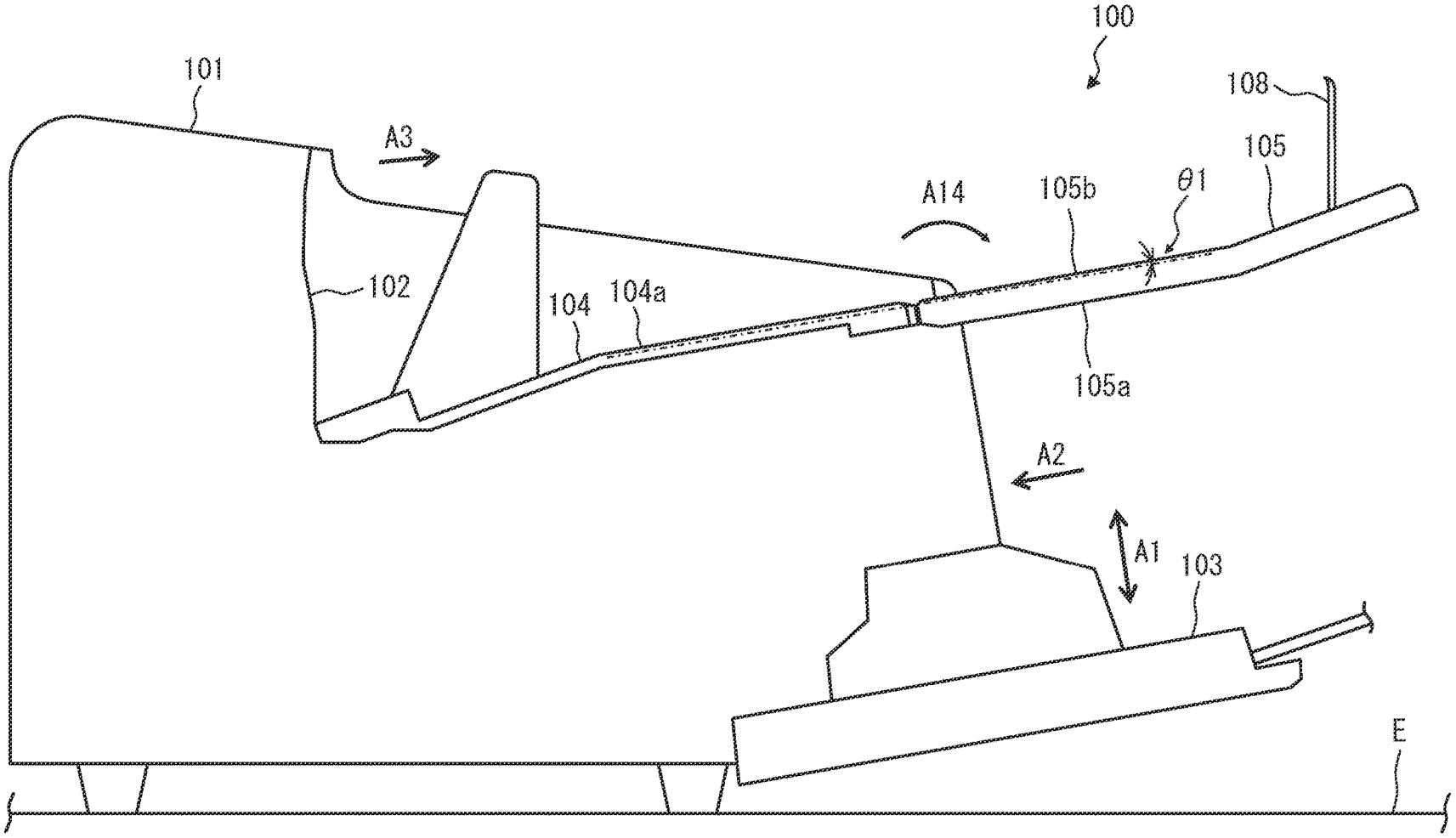
FIG. 3 is a schematic view for explaining an extension tray 105.
Figure 4:
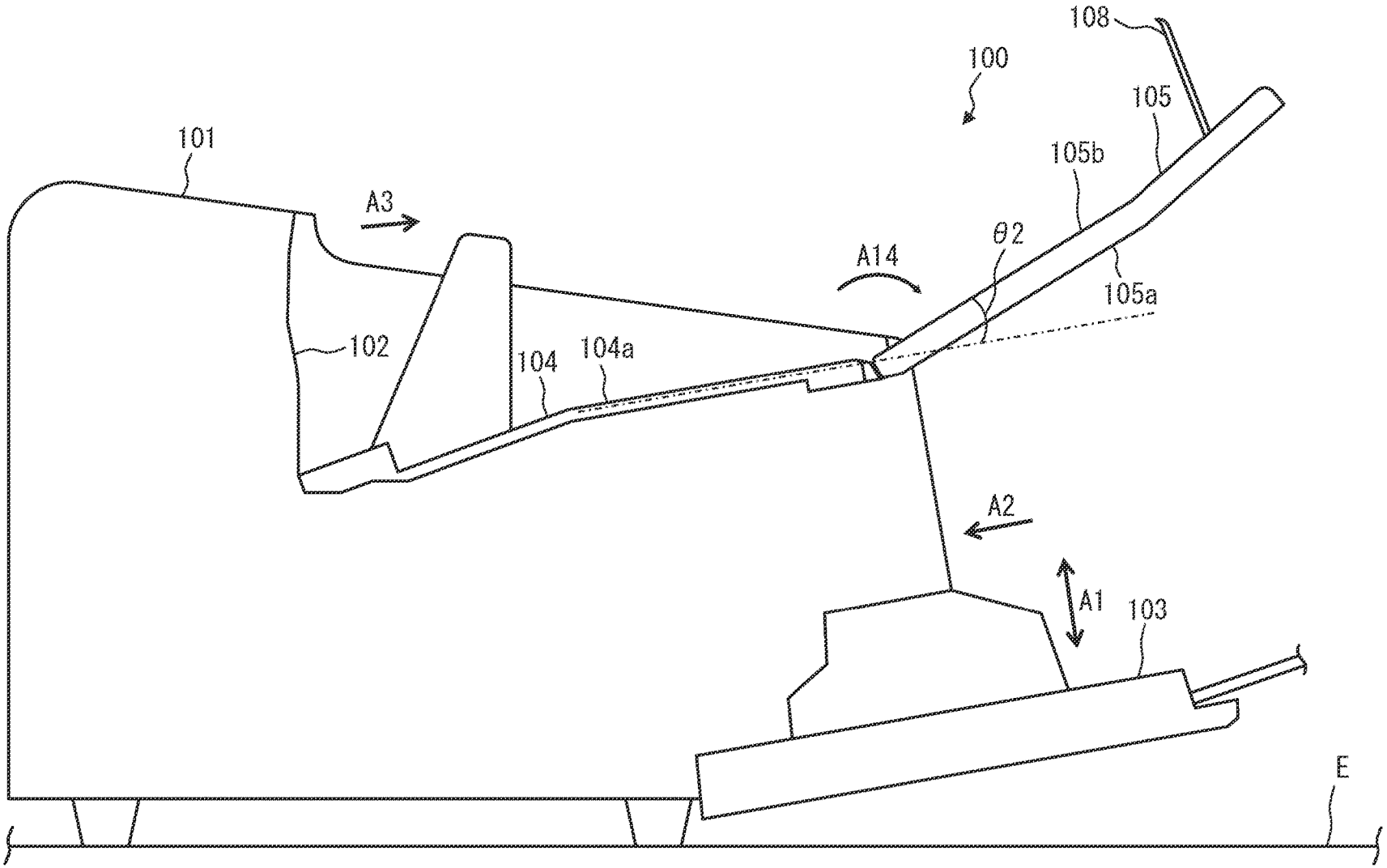
FIG. 4 is a schematic view for explaining an extension tray 105.

FIG. 3 and FIG. 4 are schematic views for explaining the extension tray 105.

As shown in FIG. 2, FIG. 3, and FIG. 4, the extension tray 105 is attached to the end part of the ejection tray 104 at the downstream side in the medium ejection direction A3 so as to be able to pivot in the direction of the arrow A14. The extension tray 105 is provided to be able to pivot centered about a shaft positioned at the end part at the ejection tray 104 side and extending in the width direction A4. The extension tray 105 has a second surface 105*b* located at an opposite side of the first surface 105*a*. The second surface 105*b* is one example of the second stacking surface.

As shown in FIG. 3 and FIG. 4, in the state where the extension tray 105 pivots in the direction of the arrow A14, the second surface 105*b* is located so as to face upward and extend the first stacking surface 104*a* of the ejection tray 104. The extension tray 105 is located at a first arrangement position (position shown in FIG. 3) where the second surface 105*b* forms a first angle θ1 with respect to the first stacking surface 104*a* and a second arrangement position (position shown in FIG. 4) where the second surface 105*b* forms a second angle θ2, different from the first angle θ1, with respect to the first stacking surface 104*a*. If the extension tray 105 is located at the first arrangement position or the second arrangement position, the medium ejected by the ejection roller 118 is stacked on the first stacking surface 104*a* and the second surface 105*b*. Due to the extension tray 105 being located at the first arrangement position or the second arrangement position, the medium ejection apparatus 100 can stack a large sized medium (for example, A4 size or A3 size medium) well.

The first angle θ1 is set to a sufficiently small angle (for example, 0°). The first angle θ1 is set to an angle of for example 0° or more and 10° or less in range. Further, the angle of the second surface 105*b* with respect to a set surface E of the medium ejection apparatus 100 when the extension tray 105 is located at the first arrangement position is also set to a sufficiently small angle (for example, 10°). The angle of the second surface 105*b* with respect to the set surface E when the extension tray 105 is located at the first arrangement position is for example set to an angle of for example 0° or more and 20° or less in range.

Due to this, if the extension tray 105 is located at the first arrangement position, the first stacking surface 104*a* and the second surface 105*b* are located so as to be flush and the first stacking surface 104*a* and the second surface 105*b* are located so as to be substantially parallel with the set surface E of the medium ejection apparatus 100. For this reason, if thin paper or another medium is ejected on the ejection tray 104 and extension tray 105, the medium moves to the opposite direction from the medium ejection direction A3 due to its own weight and the medium is kept from buckling. Therefore, the ejection tray 104 and extension tray 105 can hold the stacked medium securely.

On the other hand, the second angle θ2 is set to an angle larger than the first angle θ1 (for example, 15°). The second angle θ2 is for example set to an angle larger than 10° and 45° or less in range. Further, the angle of the second surface 105*b* with respect to the set surface E when the extension tray 105 is located at the second arrangement position is set to an angle (for example, 25°) larger than the angle of the second surface 105*b* with respect to the set surface E when the extension tray 105 is located at the first arrangement position. The angle of the second surface 105*b* with respect to the set surface E when the extension tray 105 is located at the second arrangement position is for example set to an angle of for example larger than 20° and 55° or less in range.

The stacking tray 103 for stacking the medium conveyed is provided below the extension tray 105. If the extension tray 105 is located at the second arrangement position, the extension tray 105 is located so as to be positioned higher the further to the downstream side. Therefore, sufficient space can be secured between the extension tray 105 and stacking tray 103, and a user can set the medium well on the stacking tray 103. A user can easily set the medium on the stacking tray 103 without folding up the extension tray 105 on the ejection tray 104, and the medium ejection apparatus 100 can improve the convenience to a user.

On the other hand, as shown in FIG. 2, the extension tray 105 is provided to be able to be inserted on the first stacking surface 104*a* of the ejection tray 104 so that the second surface 105*b* faces the first stacking surface 104*a*. Below, the position where the extension tray 105 is inserted on the first stacking surface 104*a* will sometimes be referred to as the "insertion position". If the extension tray 105 is located at the insertion position, the medium ejected by the ejection roller 118 is stacked on the first stacking surface 104*a* and first surface 105*a*. By virtue of the extension tray 105 being located at the insertion position, the medium ejection apparatus 100 stacks a small sized medium (for example, a medium smaller than A4 size) well while being compactly set.

As shown in FIG. 3 and FIG. 4, the end part of the extension tray 105 at the downstream side is provided with a retractable stopper 108. By the stopper 108 being raised up, the front ends of the medium of the maximum size (for example, A4 size or A3 size) which the medium ejection apparatus 100 supports, ejected to the ejection tray 104 and extension tray 105, are made to stop and the front ends of the media are aligned. On the other hand, the stopper 108 can be retracted so that the extension tray 105 can be inserted on the ejection tray 104 at the insertion position.

Figure 5:
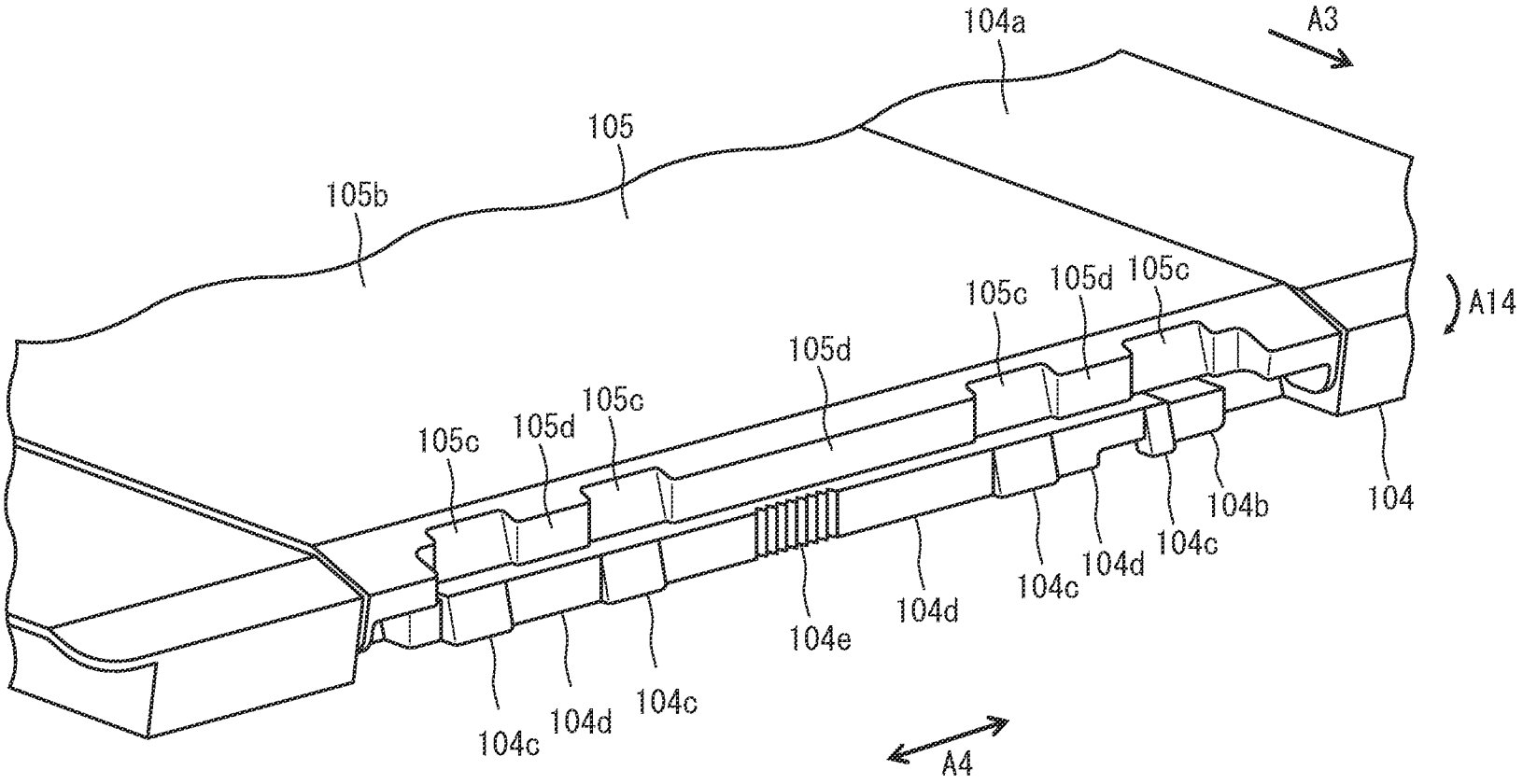
FIG. 5 is a schematic view for explaining another extension tray 105 etc.
Figure 6:
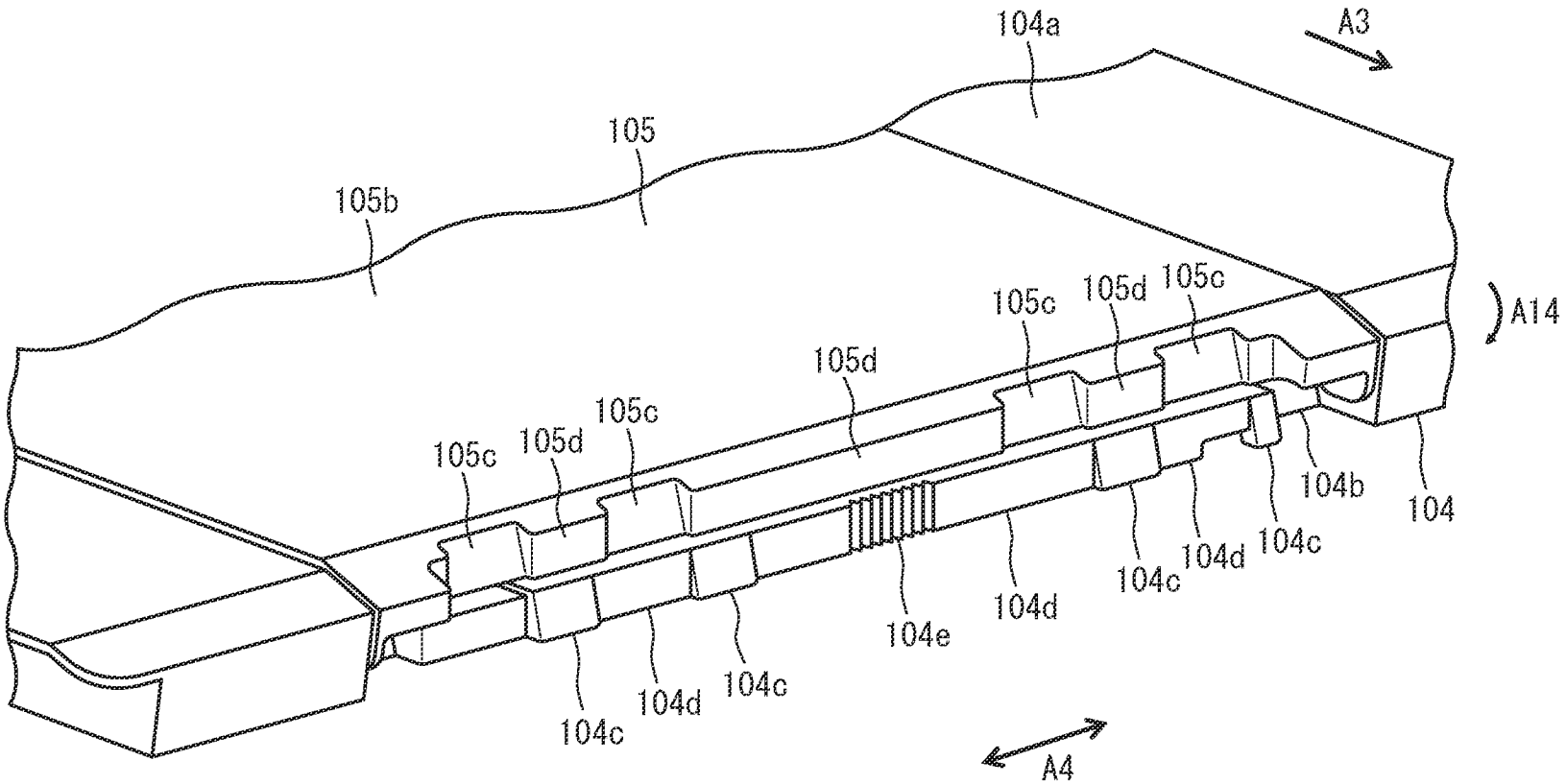
FIG. 6 is a schematic view for explaining another extension tray 105 etc.

FIG. 5 and FIG. 6 are schematic views for explaining the ejection tray 104 and extension tray 105. FIG. 5 and FIG. 6 are schematic views, seen from the downstream side, of the ejection tray 104 and extension tray 105 in the state where the extension tray 105 is located at the insertion position.

As shown in FIG. 5 and FIG. 6, the end part of the ejection tray 104 at the downstream side in the medium ejection direction A3 is provided with a movement member 104*b*. The movement member 104*b* is provided slidably in the width direction A4 perpendicular to the medium ejection direction A3. The movement member 104*b* is provided with at least one first abutting part 104*c*, at least one second abutting part 104*d*, and a holding part 104*e*. In the example shown in FIG. 5 and FIG. 6, four first abutting parts 104*c* and three second abutting parts 104*d* are provided.

The first abutting parts 104*c* are provided between the second abutting parts 104*d* so as to stick out from the second abutting parts 104*d*. In other words, the second abutting parts 104*d* are provided between the first abutting parts 104*c* so as to be recessed from the first abutting parts 104*c*. Note that the numbers of the first abutting parts 104*c* and second abutting parts 104*d* many be any numbers or may be single ones. Further, the second abutting parts 104*d* may be provided so as to stick out from the first abutting parts 104*c*.

The holding part 104*e* has a sawtooth shape. A user can press his finger against the holding part 104*e* to make the movement member 104*b* move and thereby make the movement member 104*b* slide smoothly by hand. Due to the movement member 104*b*, the set of the first abutting parts 104*c* and second abutting parts 104*d* is provided slidably in the width direction A4 perpendicular to the medium ejection direction A3. By virtue of this arrangement, a user can easily change the abutting positions of the abutting parts and the later explained abutted parts and can easily change the angle of the extension tray 105 with respect to the ejection tray 104. Therefore, the medium ejection apparatus 100 can improve the convenience to a user.

On the other hand, the end part of the extension tray 105 at the ejection tray 104 side is provided with at least one first abutted part 105*c* and at least one second abutted part 105*d*. In the example shown in FIG. 5 and FIG. 6, four first abutted parts 105*c* and three second abutted parts 105*d* are provided.

The first abutted parts 105*c* are provided between the second abutted parts 105*d* to be recessed from the second abutted parts 105*d*. In other words, the second abutted parts 105*d* are provided between the first abutted part 105*c* so as to stick out from the first abutted parts 105*c*. Note that the numbers of the first abutted parts 105*c* and second abutted parts 105*d* may be any numbers or may be single ones. Further, the first abutted parts 105*c* may also be provided so as to stick out from the second abutted parts 105*d*.

In FIG. 5, the movement member 104*b* is located at an initial position in the width direction A4 where the first abutting parts 104*c* are aligned with the first abutted parts 105*c* and the second abutting parts 104*d* are aligned with the second abutted parts 105*d*. On the other hand, in FIG. 6, the movement member 104*b* is moved from the initial position and is located at a movement position in the width direction A4 where the first abutting parts 104*c* are aligned with the second abutted parts 105*d* and the second abutting parts 104*d* are aligned with the first abutted parts 105*c*.

Figure 7:
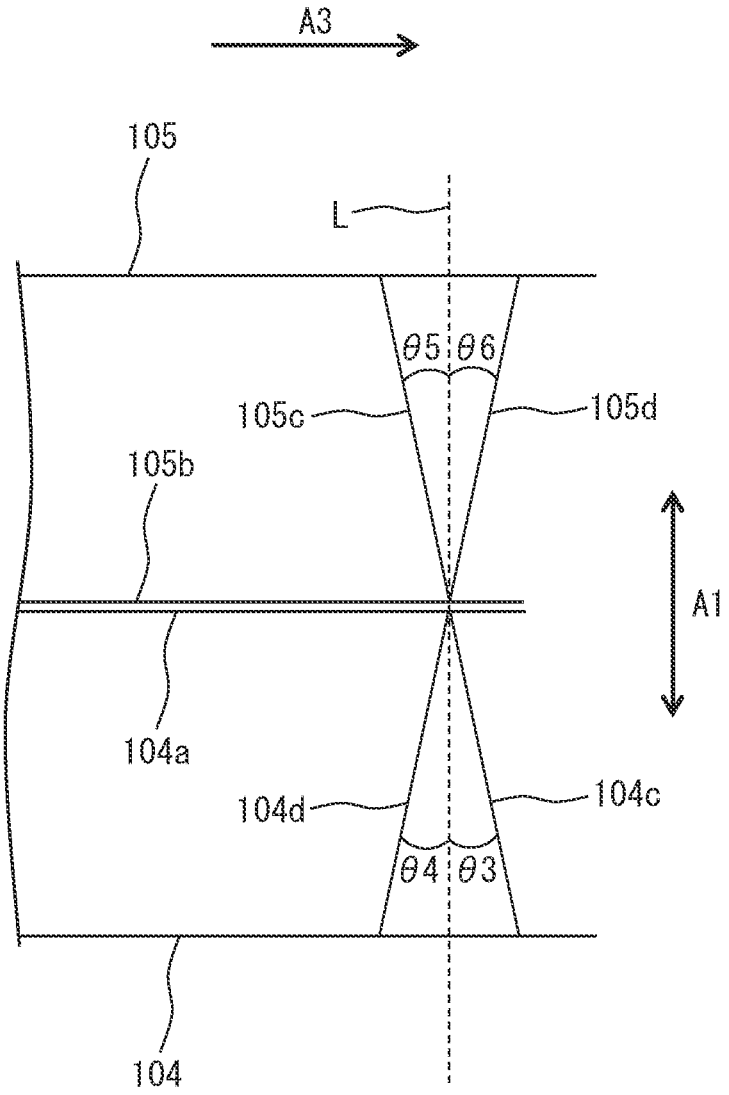
FIG. 7 is a schematic view for explaining an inclination of a first abutting part 104*c* etc.

FIG. 7 is a schematic view for explaining the inclinations of the first abutting parts 104*c*, second abutting parts 104*d*, first abutted parts 105*c*, and second abutted parts 105*d*. FIG. 7 is a schematic view, seen from the side, of the vicinity of the first abutting parts 104*c*, second abutting parts 104*d*, first abutted parts 105*c*, and second abutted parts 105*d*.

As shown in FIG. 7, the first abutting parts 104*c* are inclined so as to be positioned lower the further they are to the downstream side. The first abutting parts 104*c* are inclined so as to form a third angle θ3 with respect to a line L perpendicular to the first stacking surface 104*a*. The third angle θ3 is for example set to an angle larger than 0° and smaller than 45°. The second abutting parts 104*d* are inclined so as to be positioned lower the further they are to the upstream side. The second abutting parts 104*d* are inclined so as to form a fourth angle θ4 with respect to a line L perpendicular to the first stacking surface 104*a*. The fourth angle θ4 is for example set to an angle larger than 0° and smaller than 45°.

Further, the first abutted parts 105*c* are inclined so as to be positioned lower the further they are to the downstream side. The first abutted parts 105*c* are inclined so as to form a fifth angle θ5 with respect to a line L perpendicular to the first stacking surface 104*a*. The fifth angle θ5 is for example set to an angle larger than 0° and smaller than 45°. The second abutted parts 105*d* are inclined so as to be positioned lower the further they are to the upstream side. The second abutted parts 105*d* are inclined so as to form a sixth angle θ6 with respect to a line L perpendicular to the first stacking surface 104*a*. The sixth angle θ6 is for example set to an angle larger than 0° and smaller than 45°.

In the above way, the first abutting parts 104*c* are provided so as to stick out from the second abutting parts 104*d* while the second abutted parts 105*d* are provided so as to stick out from the first abutted parts 105*c*. Even if the first abutting parts 104*c*, second abutting parts 104*d*, first abutted parts 105*c*, and second abutted parts 105*d* are not inclined, the abutting parts and the abutted parts abutting against the abutting parts do not contact each other over their entire regions, with the result that the ejection tray 104 cannot stably support the extension tray 105. Due to the first abutting parts 104*c*, second abutting parts 104*d*, first abutted parts 105*c*, and second abutted parts 105*d* being respectively inclined, the abutting parts and the abutted parts abutting against the abutting parts contact each other over their entire regions, and the ejection tray 104 can stably support the extension tray 105. Note that the first abutting parts 104*c*, second abutting parts 104*d*, first abutted parts 105*c*, and/or second abutted parts 105*d* need not be inclined.

The third angle θ3 and the fifth angle θ5 are set at substantially the same angle, while the fourth angle θ4 and the fifth angle θ5 are set at substantially the same angle. Due to this, when the first abutting parts 104*c* and the first abutted parts 105*c* are located to abut and the second abutting parts 104*d* and the second abutted parts 105*d* are located to abut, the second surface 105*b* are located so as to be greatly inclined with respect to the first stacking surface 104*a*. On the other hand, when the first abutting parts 104*c* and the second abutted parts 105*d* are located to abut, the second surface 105*b* is located so as to be inclined with respect to the first stacking surface 104*a* so as to be positioned higher the further to the downstream side.

Figure 8:
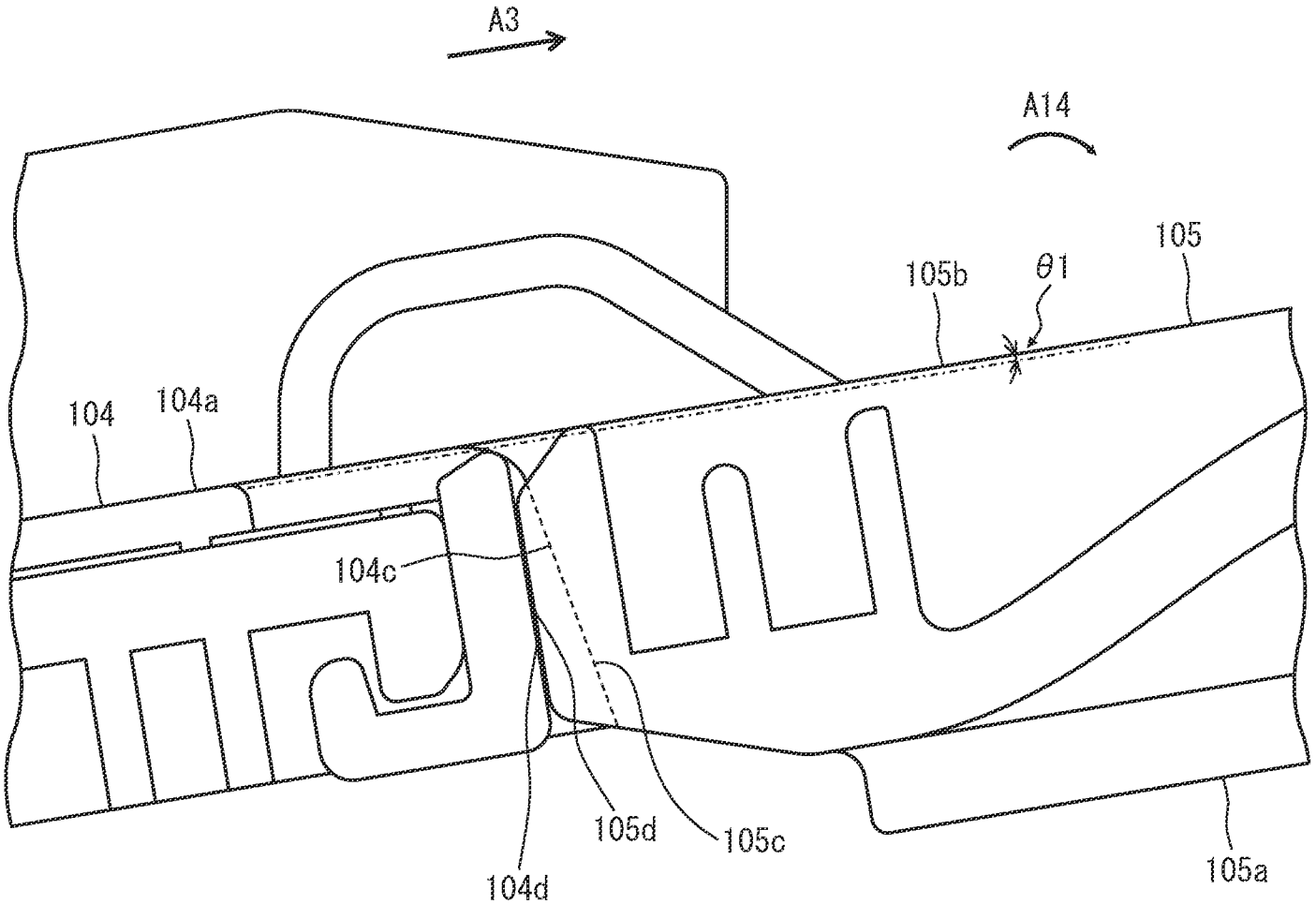
FIG. 8 is a schematic view for explaining an abutting relationship.
Figure 9:
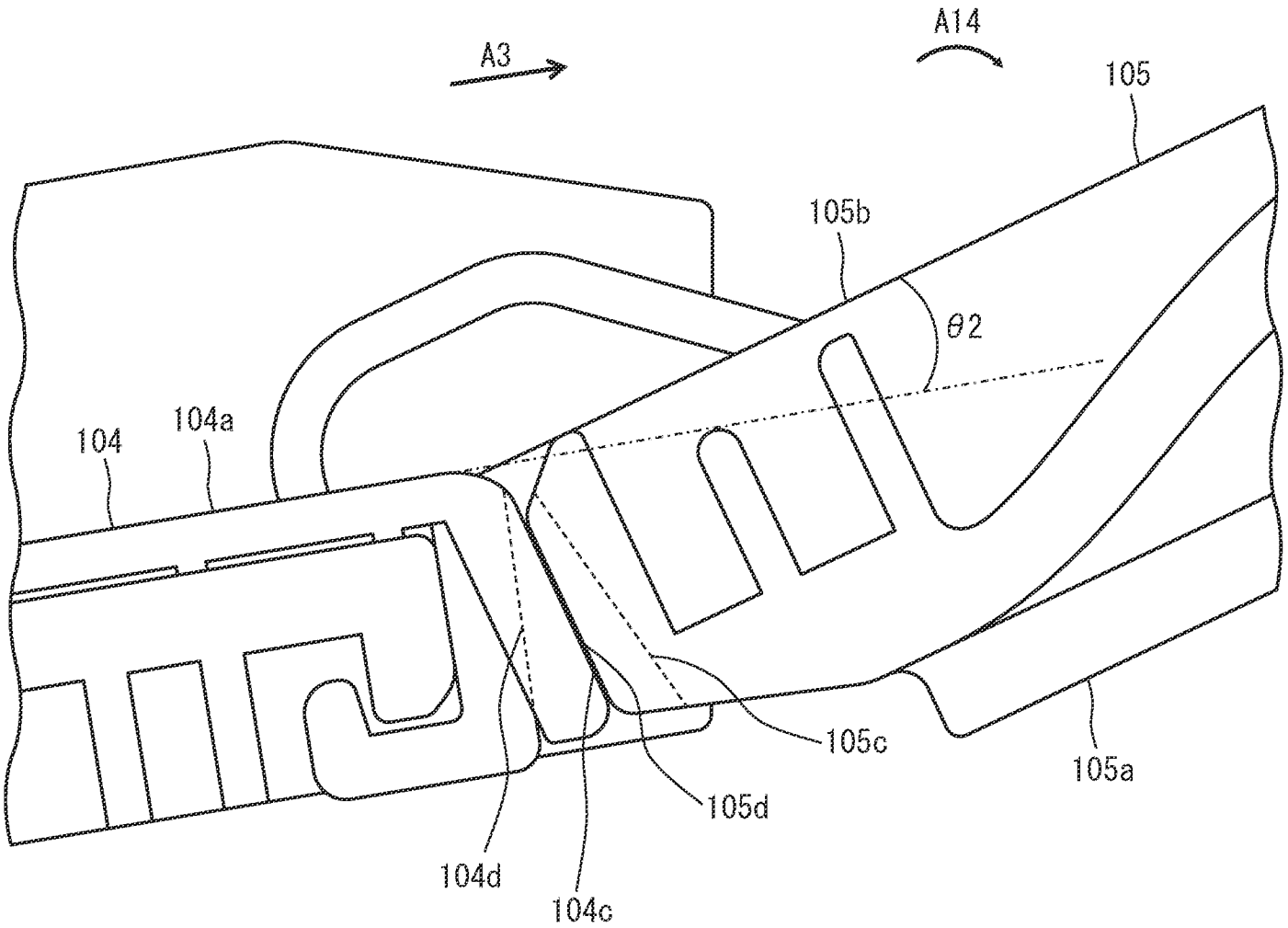
FIG. 9 is a schematic view for explaining an abutting relationship.

FIG. 8 and FIG. 9 are schematic views for explaining the abutting relationship between the ejection tray 104 and extension tray 105. FIG. 8 and FIG. 9 are cross-sectional views of the vicinity of the first abutting parts 104*c*, second abutting parts 104*d*, first abutted parts 105*c*, and second abutted parts 105*d* sliced at a plane perpendicular to the width direction A4 and passing through the second abutted parts 105*d*. FIG. 8 shows the state where the movement member 104*b* is located at the initial position and the extension tray 105 is opened from the ejection tray 104. FIG. 9 shows the state where the movement member 104*b* is located at the movement position and the extension tray 105 is opened from the ejection tray 104.

As shown in FIG. 8, if the movement member 104*b* is located at the initial position and the extension tray 105 is opened from the ejection tray 104, the first abutted parts 105*c* abut against the first abutting parts 104*c* and the second abutted parts 105*d* abut against the second abutting parts 104*d*. Due to this, the second surface 105*b* is located to form the first angle θ1 with respect to the first stacking surface 104*a*, and the extension tray 105 is located at the first arrangement position shown in FIG. 3. Therefore, the ejection tray 104 and extension tray 105 can hold the stacked medium well. Note that if the movement member 104*b* is located at the initial position and the extension tray 105 is opened from the ejection tray 104, either of the first abutted parts 105*c* and second abutted parts 105*d* may be located so as to move away from the ejection tray 104.

On the other hand, as shown in FIG. 9, if the movement member 104*b* is located at the movement position and the extension tray 105 is opened from the ejection tray 104, the second abutted parts 105*d* abut against the first abutting parts 104*c*. In this case, the second abutting parts 104*d* and the first abutted parts 105*c* respectively move away from the extension tray 105 and ejection tray 104. Due to this, the second surface 105*b* is located to form the second angle θ2 with respect to the first stacking surface 104*a*, and the extension tray 105 is located at the second arrangement position shown in FIG. 4. Therefore, sufficient space is secured between the extension tray 105 and stacking tray 103 and a user can set the medium well on the stacking tray 103.

In this way, the first abutting parts 104*c* are provided so as to stick out from the second abutting parts 104*d*, and the second abutted parts 105*d* are provided so as to stick out from the first abutted parts 105*c*. Due to this, the second surface 105*b* is located to form the first angle θ1 with respect to the first stacking surface 104*a* by the first abutted parts 105*c* abutting against the first abutting parts 104*c*. On the other hand, the second surface 105*b* is located to form the second angle θ2, different from the first angle θ1, with respect to the first stacking surface 104*a* by the second abutted parts 105*d* abutting against the first abutting parts 104*c*. Therefore, the medium ejection apparatus 100 can suitably change an angle of the extension tray 105 with respect to the ejection tray 104.

Figure 10A:
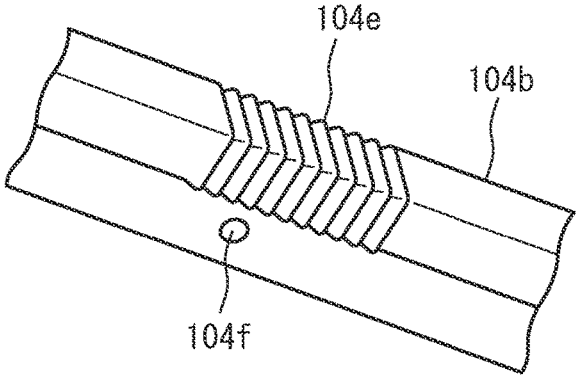
FIG. 10A is a schematic view for explaining a movement member 104*b*.
Figure 10B:
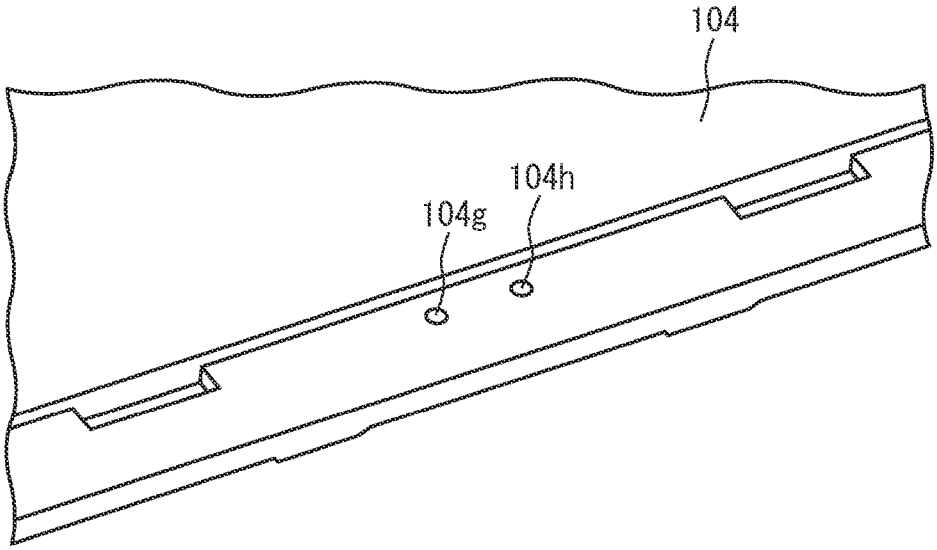
FIG. 10B is a schematic view for explaining a movement member 104*b*.
Figure 10C:
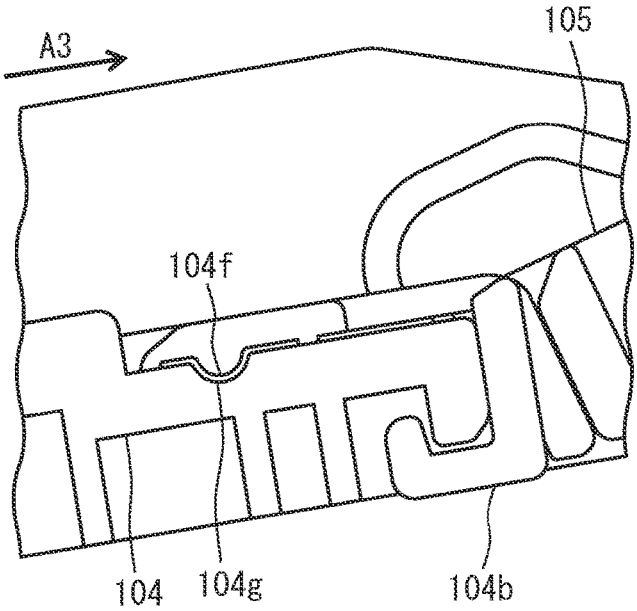
FIG. 10C is a schematic view for explaining a movement member 104*b*.

FIGS. 10A, 10B, and 10C are schematic views for explaining the movement member 104*b*.

FIG. 10A is a schematic view, seen from below, of the movement member 104*b* in the state detached from the ejection tray 104. As shown in FIG. 10A, the bottom surface of the movement member 104*b* (surface facing ejection tray 104) is provided with a projecting part 104*f*.

FIG. 10B is a schematic view, seen from above, of the ejection tray 104 in the state where the movement member 104*b* is detached. As shown in FIG. 10B, the top surface of the ejection tray 104 (surface facing movement member 104*b*) is provided with a plurality of recessed parts 104*g*, 104*h* located spaced apart in the movement direction of the movement member 104*b* (width direction A4).

FIG. 10C is a cross-sectional view of the vicinity of the projecting part 104*f* of the ejection tray 104 in the state where the movement member 104*b* is attached, sliced at the plane perpendicular to the width direction A4 and passing through the projecting part 104*f*. As shown in FIG. 10C, the projecting part 104*f* engages with one of the plurality of recessed parts 104*g*, 104*h* whereby the movement member 104*b* is interlocked (fixed) with the ejection tray 104. Due to this, the ejection tray 104 can stably support the movement member 104*b* and stably support the extension tray 105.

Figure 11:
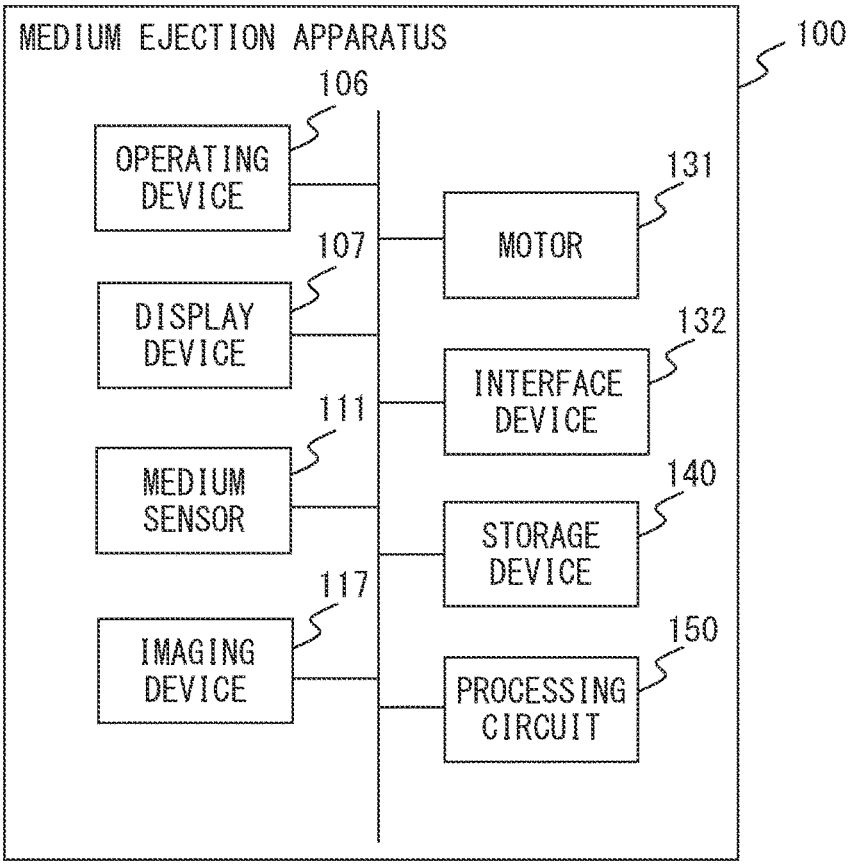
FIG. 11 is a block diagram showing a schematic constitution of a medium ejection apparatus 100.

FIG. 11 is a block diagram showing the schematic constitution of the medium ejection apparatus 100.

The medium ejection apparatus 100 further has, in addition to the above-mentioned constitution, a motor 131, interface device 132, storage device 140, processing circuit 150, etc.

The motor 131 includes one or more motors. In accordance with a control signal from the processing circuit 150, the motor 131 makes the pick roller 112, feed roller 113, separation roller 114, first to fifth conveyance rollers 115*a* to 115*e*, and/or ejection roller 118 rotate to convey the medium and cause the stacking tray 103 move. Note that the first to sixth driven rollers 116*a* to 116*f* may also be provided to not be driven to rotate by the first to fifth conveyance rollers 115*a* to 115*e* or ejection roller 118, but rotate in accordance with the drive force of the motor 131.

The interface device 132 has an interface circuit based on for example a USB or other serial bus and is electrically connected with a not shown information processing device (for example, a personal computer, mobile information terminal, etc.) to transmit and receive input images and various information. Further, instead of the interface device 132, a communication part having an antenna transmitting and receiving wireless signals and a wireless communication interface circuit for transmitting and receiving signals through a wireless communication line in accordance with a predetermined communication protocol may be used. The predetermined communication protocol is, for example, a wireless LAN (local area network). The communication part may also have a wired communication interface circuit for transmitting and receiving signals through a wire communication line in accordance with a wired LAN or other communication protocol.

The storage device 140 has a RAM (random access memory), ROM (read only memory), or other memory device, hard disk or other fixed disk device, flexible disk, optical disk, or other portable storage device, etc. Further, the storage device 140 stores computer programs, databases, tables, etc. used for various processing of the medium ejection apparatus 100. The computer programs may be installed on the storage device 140 from a computer-readable, non-transitory medium such as a CD-ROM (compact disc read only memory), DVD-ROM (digital versatile disc read only memory), etc., by using a well-known setup program etc.

The processing circuit 150 operates based on a program stored in advance in the storage device 140. The processing circuit is for example a CPU (central processing unit). As the processing circuit 150, a DSP (digital signal processor), LSI (large scale integrated circuit), ASIC (application specific integrated circuit), FPGA (field-programmable gate array), etc. may be used.

The processing circuit 150 is connected to the operating device 106, display device 107, medium sensor 111, imaging device 117, motor 131, interface device 132, storage device 140, etc. and controls these parts. The processing circuit 150 performs control for driving the motor 131, control for imaging of the imaging device 117, etc., based on the medium signal received from the medium sensor 111. The processing circuit 150 acquires an input image from the imaging device 117 and sends it through the interface device 132 to the information processing device.

Figure 12:
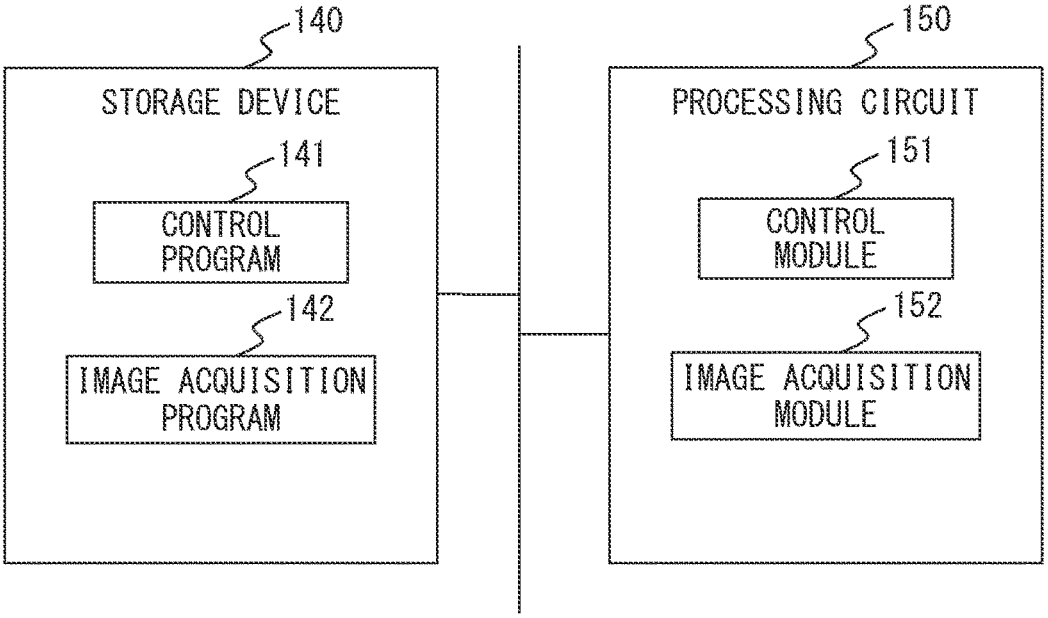
FIG. 12 is a view showing a schematic constitution of a storage device 140 and a processing circuit 150.

FIG. 12 is a view showing the schematic constitution of the storage device 140 and processing circuit 150.

As shown in FIG. 12, the storage device 140 stores the control program 141, image acquisition program 142, etc. These programs are function modules loaded by software operating on a processor. The processing circuit 150 reads the programs stored in the storage device 140 and operates in accordance with the read programs. Due to this, the processing circuit 150 functions as a control module 151 and image acquisition module 152.

Figure 13:
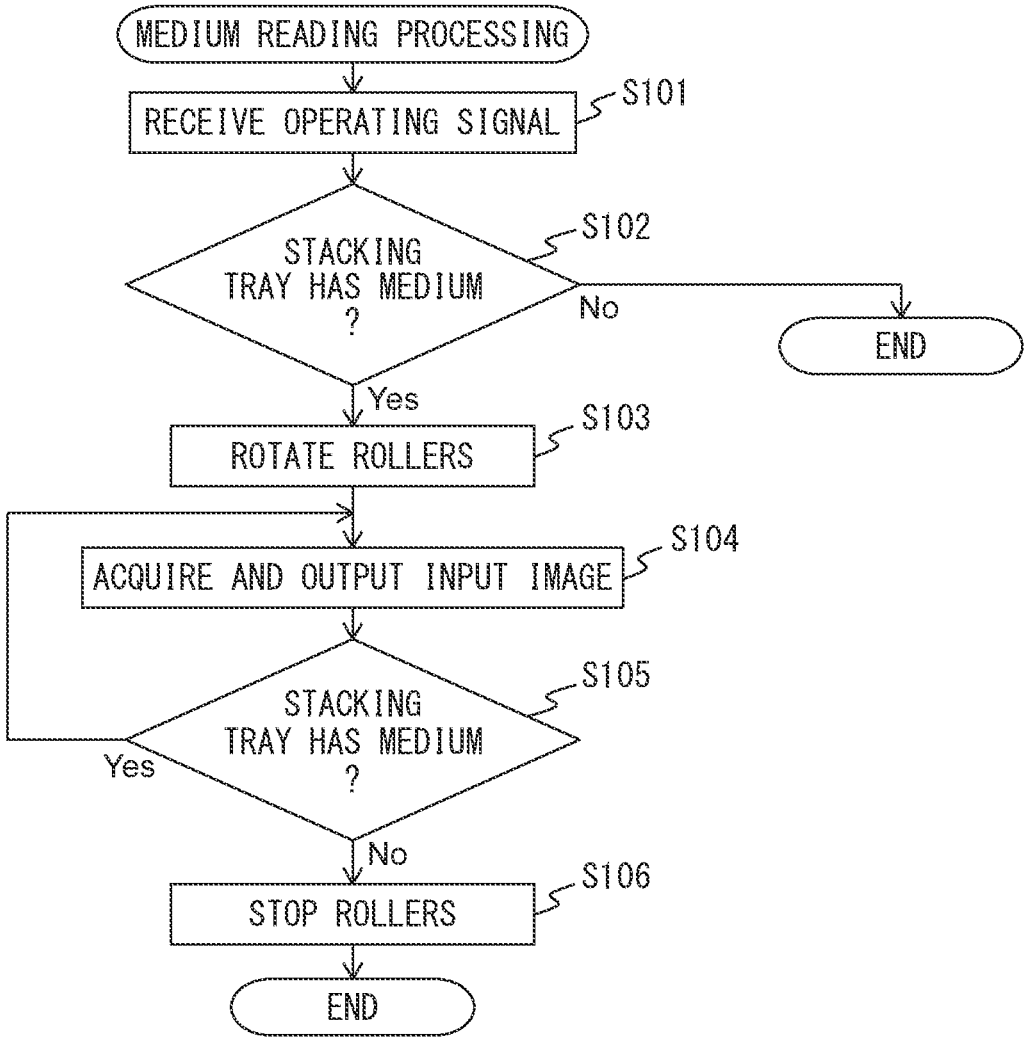
FIG. 13 is a flow chart showing an example of operation of medium reading processing.

FIG. 13 is a flow chart showing an example of operation of the medium reading processing of the medium ejection apparatus 100.

Below, referring to the flow chart shown in FIG. 13, an example of operation of the medium reading processing of the medium ejection apparatus 100 will be explained. Note that the flow of operation explained below is performed mainly by the processing circuit 150 in cooperation with the elements of the medium ejection apparatus 100 based on a program stored in the storage device 140 in advance.

First, the control module 151 stands by until receiving an instruction for reading a medium from a user using the operating device 106 or information processing apparatus and receiving an operating signal for instructing reading of the medium from the operating device 106 or interface device 132 (step S101).

Next, the control module 151 acquires a medium signal from the medium sensor 111 and determines whether the stacking tray 103 has the medium stacked on it, based on the acquired medium signal (step S102). If the stacking tray 103 has the medium stacked on it, the control module 151 ends the series of steps.

On the other hand, if the medium is stacked on the stacking tray 103, the control module 151 drives the motor 131 to make the stacking tray 103 rise to a position able to feed the medium and makes the rollers rotate to make them feed and convey the medium (step S103).

Next, the control module 151 makes the imaging device 117 capture an image of the medium, acquires the input image from the imaging device 117, and transmits the acquired input image through the interface device 132 to the information processing apparatus to output it (step S104).

Next, the control module 151 determines whether the stacking tray 103 has the medium remaining on it, based on the medium signal received from the medium sensor 111 (step S105). If the stacking tray 103 has the medium remaining on it, the control module 151 returns the processing to step S104 and repeats the processing of steps S104 to S105.

On the other hand, if the stacking tray 103 has no medium remaining on it, the control module 151 controls the motor 131 so as to make the rollers stop (step S106) and ends the series of steps.

As explained in detail above, at the medium ejection apparatus 100, at the position where the ejection tray 104 and the extension tray 105 provided rotatably from the ejection tray 104 abut, the movement member 104*b* able to change the angle formed by the ejection tray 104 and extension tray 105 is provided. Due to this, the medium ejection apparatus 100 can suitably change the arrangement position of the extension tray 105 for stacking the ejected medium.

The medium ejection apparatus 100 can reduce the device size while enabling switching in accordance with the application between a mode improving the stackability of the ejected medium and a mode improving the settability of the medium by a user.

Figure 14:
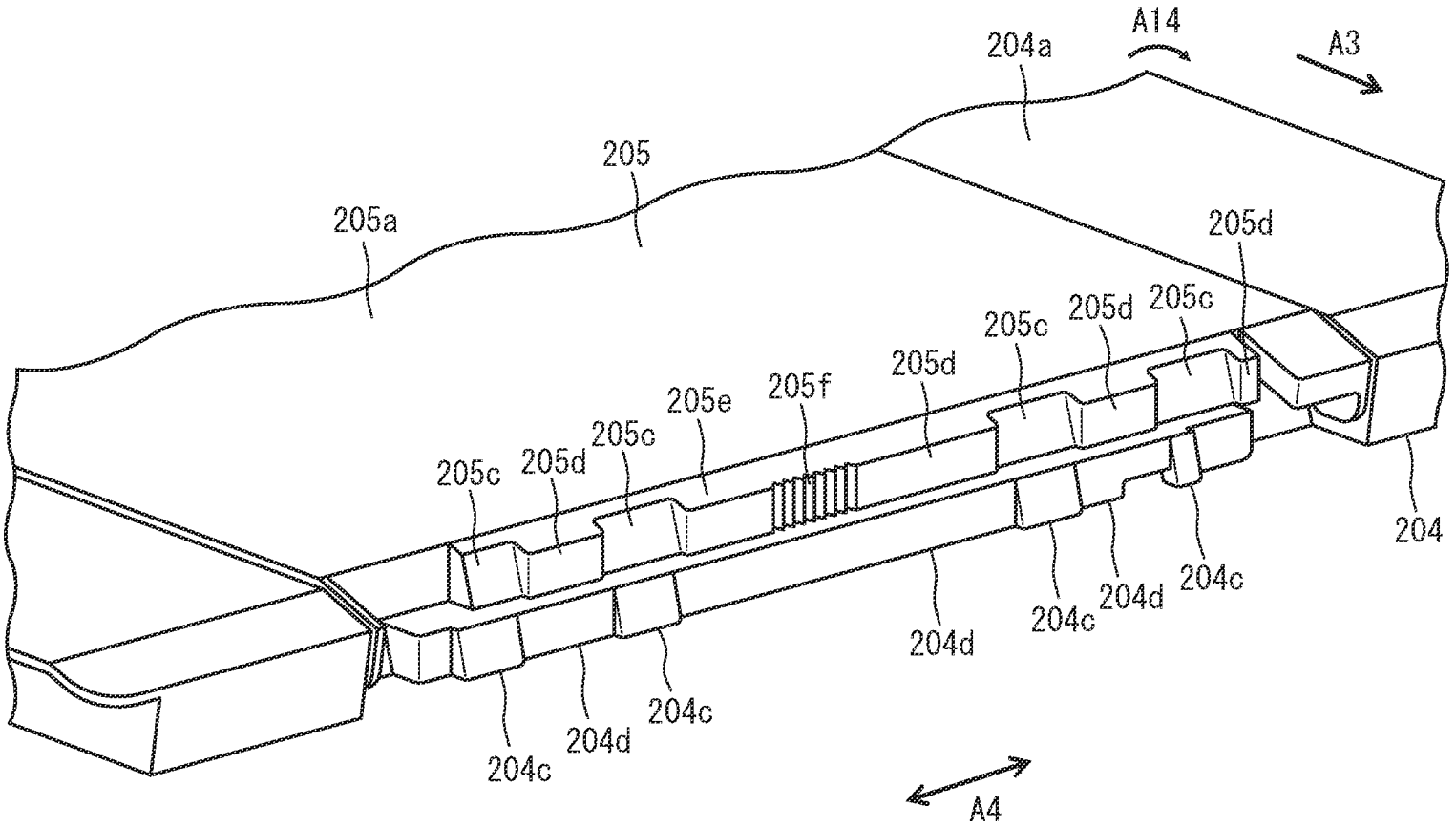
FIG. 14 is a schematic view for explaining another extension tray 205 etc.
Figure 15:
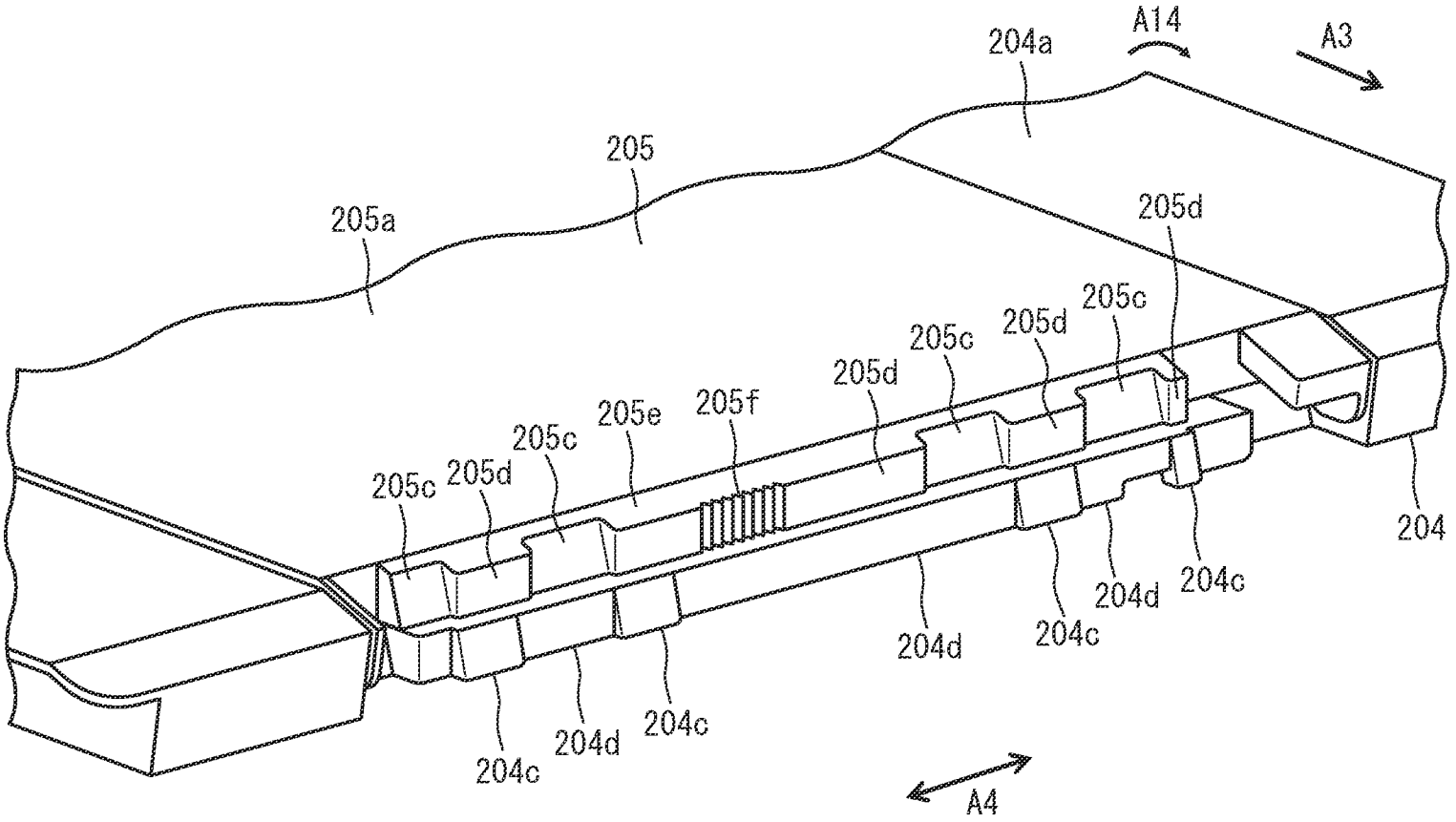
FIG. 15 is a schematic view for explaining another extension tray 205 etc.

FIG. 14 and FIG. 15 are schematic views for explaining an ejection tray 204 and extension tray 205 of a medium ejection apparatus according to another embodiment. FIG. 14 and FIG. 15 are schematic views of the ejection tray 204 and extension tray 205, seen from the downstream side, in the state where the extension tray 205 is located at the insertion position.

The ejection tray 204 and extension tray 205 are respectively used in place of the ejection tray 104 and extension tray 105 and have structures and functions similar to the ejection tray 104 and extension tray 105. However, the ejection tray 204 is not provided with the movement member 104*b*. Instead, the end part of the extension tray 205 at the ejection tray 204 side is provided with a movement member 205*e*.

The movement member 205*e* is provided slidably in the width direction A4 perpendicular to the medium ejection direction A3. The movement member 205*e* is provided with at least one first abutted part 205*c*, at least one second abutted part 205*d*, and a holding part 205*f*. The first abutted part 205*c* and second abutted part 205*d* respectively have structures and functions similar to the first abutted part 105*c* and second abutted part 105*d*. The holding part 205*f* has a structure and function similar to the holding part 104*e*. Due to the movement member 205*e*, the set of the first abutted parts 205*c* and second abutted parts 205*d* is provided slidably in the width direction A4 perpendicular to the medium ejection direction A3. Due to this, a user can easily change the abutting positions of the abutting parts and abutted parts and can easily change the angle of the extension tray 205 with respect to the ejection tray 204. Therefore, the medium ejection apparatus can improve the convenience to a user.

On the other hand, the end part of the ejection tray 204 downstream in the medium ejection direction A3 is provided with at least one first abutting part 204*c* and at least one second abutting part 204*d*. The first abutting part 204*c* and second abutting part 204*d* respectively have structures and functions similar to the first abutting part 104*c* and second abutting part 104*d*.

In FIG. 14, the movement member 205*e* is located at an initial position in the width direction A4 where the first abutting parts 204*c* are aligned with the first abutted parts 205*c* and the second abutting parts 204*d* are aligned with the second abutted parts 205*d*. If the movement member 205*e* is located at the initial position and the extension tray 205 is opened from the ejection tray 204, the first abutted parts 205*c* abut against the first abutting parts 204*c* and the second abutted parts 205*d* abut against the second abutting parts 204*d*. Due to this, the second surface 105*b* of the extension tray 205 is located to form the first angle θ1 with respect to the first stacking surface 104*a* of the ejection tray 204, and the extension tray 205 is located at the first arrangement position shown in FIG. 3A.

On the other hand, at FIG. 15, the movement member 205*e* is moved from the initial position and is located, in the width direction A4, at a movement position where the first abutting parts 204*c* are aligned with the second abutted parts 205*d* and the second abutting parts 204*d* are aligned with the first abutted parts 205*c*. If the movement member 205*e* is located at the movement position and the extension tray 205 is opened from the ejection tray 204, the second abutted parts 205*d* abut against the first abutting parts 204*c*. Due to this, the second surface 105*b* of the extension tray 205 is located so as to form the second angle θ2 with respect to the first stacking surface 104*a* of the ejection tray 204, and the extension tray 205 is located at the second arrangement position shown in FIG. 3B.

As explained in detail above, the medium ejection apparatus 100 can suitably change the arrangement position of the extension tray 205 for stacking the ejected medium even if the extension tray 205 is provided with the movement member 205*e*.

Figure 16:
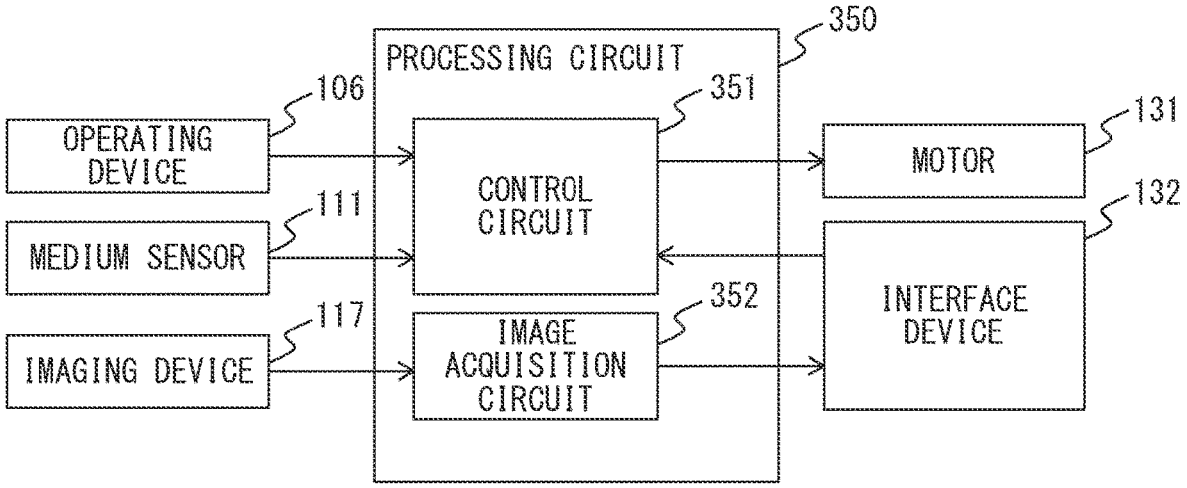
FIG. 16 is a view showing a schematic constitution of a processing circuit 350 according to another embodiment.

FIG. 16 is a view showing the schematic constitution of a processing circuit 350 of a medium ejection circuit 350 of a medium ejection apparatus according to another embodiment.

The processing circuit 350 is used in place of the processing circuit 150 of the medium ejection apparatus 100 and performs medium reading processing etc. in place of the processing circuit 150. The processing circuit 350 has a control circuit 351, image acquisition circuit 352, etc. Note that these parts may also be configured by respectively independent integrated circuits, microprocessors, firmware, etc.

The control circuit 351 is one example of a control module and has a function similar to the control module 151. The control circuit 351 receives an operating signal from the operating device 106 or interface device 132 and a medium signal from the medium sensor 111. The control circuit 351 controls the motor 131, based on the various received information.

The image acquisition circuit 352 is one example of an image acquisition module and has a function similar to the image acquisition module 152. The image acquisition circuit 352 receives an input image from the imaging device 117 and outputs it to the interface device 132.

As explained in detail above, the ejection apparatus can suitably change the arrangement position of the extension tray for stacking the ejected medium, even if using the processing circuit 350.

Above, preferred embodiments were explained, but the embodiments are not limited to these. For example, the extension tray may be provided so that the inclination of the second surface with respect to the first stacking surface of the ejection tray changes in three or more stages. In this case, the ejection tray is provided with one or more abutting parts so as to be further recessed from the second abutting part while the extension tray is provided with one or more abutted parts so as to further project out from the second abutted part.

The medium ejection apparatus according to the embodiments can suitably change an arrangement position of the tray for stacking the ejected medium.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that various changes, substitutions, and alterations can be made hereto without departing from the spirit and scope of the invention.

What is claimed is:

1. A medium ejection apparatus comprising:

an ejection roller to eject a medium;

an ejection tray having a first stacking surface, to stack a medium ejected by the ejection roller; and an extension tray rotatably attached to an end part of the ejection tray at a downstream side in a medium ejection direction, and having a second stacking surface, to stack a medium ejected by the ejection roller, wherein an end part of the ejection tray at the downstream side is provided with a first abutting part and second abutting part, wherein the end part of the extension tray at the ejection tray side is provided with a first abutted part and second abutted part, wherein the second stacking surface is located forming a first angle with respect to the first stacking surface by the first abutted part abutting against the first abutting part, and wherein the second stacking surface is located forming a second angle, different from the first angle, with respect to the first stacking surface by the second abutted part abutting against the first abutting part.

2. The medium ejection apparatus according to claim 1, wherein the first abutting part is provided so as to stick out from the second abutting part, and wherein the second abutted part is provided so as to stick out from the first abutted part.

3. The medium ejection apparatus according to claim 1, wherein at least one of the set of the first abutting part and the second abutting part and the set of the first abutted part and the second abutted part is provided to be able to slide in a direction perpendicular to the medium ejection direction.

4. The medium ejection apparatus according to claim 1, wherein the extension tray is provided to be able to be inserted on the ejection tray so that the second stacking surface faces the first stacking surface.

5. The medium ejection apparatus according to claim 1, further comprising a stacking tray provided below the extension tray, to stack the medium to be conveyed.

* * * * *